US011620970B1

(12) United States Patent
Patlove

(10) Patent No.: US 11,620,970 B1
(45) Date of Patent: Apr. 4, 2023

(54) MOUTHPIECE FOR SINGLE-REED WIND INSTRUMENTS

(71) Applicant: Silas M Patlove, Oakland, CA (US)

(72) Inventor: Silas M Patlove, Oakland, CA (US)

(73) Assignee: Silas M. Patlove, Oakland, CA (US)

( * ) Notice: Subject to any disclaimer, the term of this patent is extended or adjusted under 35 U.S.C. 154(b) by 0 days.

(21) Appl. No.: 17/892,079

(22) Filed: Aug. 21, 2022

(51) Int. Cl.
*G10D 9/02* (2020.01)

(52) U.S. Cl.
CPC ..... *G10D 9/02* (2013.01)

(58) Field of Classification Search
CPC ..... G10D 9/02
USPC ..... 84/398
See application file for complete search history.

(56) References Cited

U.S. PATENT DOCUMENTS 2,530,155 A * 11/1950 De Luca ..... G10D 9/02 84/383 R
5,303,628 A * 4/1994 Salazar ..... G10D 9/035 84/383 R
2013/0160632 A1* 6/2013 Nowselski ..... G10D 9/02 84/465
2017/0337908 A1* 11/2017 Son ..... G10D 7/00
2018/0166050 A1* 6/2018 Rovner ..... G10D 9/02
2019/0213980 A1* 7/2019 Rovner ..... G10D 9/02

* cited by examiner

*Primary Examiner* — Jeffrey Donels

(57) ABSTRACT

A mouthpiece for a single reed wind instrument including a body having a beak and either a tenon or a shank, the body having a facing having a window, the facing supporting a reed secured to the body using a ligature, the gap between the surface of the facing at the tip and the reed forming an opening at the tip of the beak; protrusions extending laterally on either side of the window adjacent to the tip, a first surface of each protrusion being flush with the surface of the facing and a second surface of each protrusion being flush being flush with the surface of the beak on the opposite side as the facing, the first and second surface of each protrusion coming together as each member extends laterally from the body, the shape of each member configured to create a substantially lenticular cross section in the area where a player's lips are applied to the tip of the beak.

10 Claims, 10 Drawing Sheets

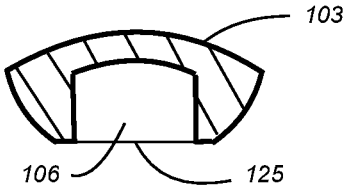
FIG. 7.1
(Prior Art)
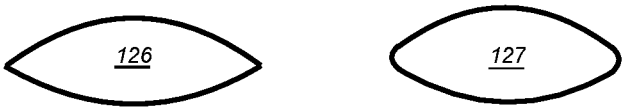
FIG. 7.2
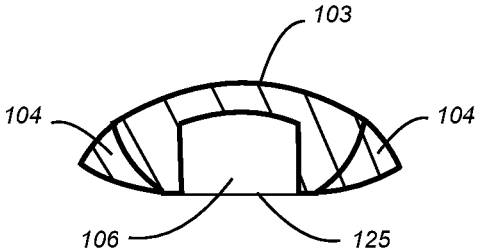
FIG. 8.1

MOUTHPIECE FOR SINGLE-REED WIND INSTRUMENTS

BACKGROUND

Technical Field

This disclosure relates generally to the field of single-reed wind instruments, such as clarinets and saxophones, specifically mouthpieces for such single-reed wind instruments.

Background of the Invention

Wind instruments that use reeds are divided into single reed and double reed groups. Double reed instruments (e.g. oboes and bassoons) utilize two reeds bound together, that vibrate against each other to generate sound. In contrast, single reed instruments (e.g. clarinets and saxophones) utilize one reed, which is attached to and vibrates against a mouthpiece. The present invention is directed towards aspects of the external shape of single reed wind instrument mouthpieces. The basic exterior shape of single reed woodwind mouthpieces is long established, and has generally changed very little in its most common embodiments, since the earliest development of such mouthpieces. This basic exterior shape has been standardized so that one may purchase a mouthpiece for any single reed wind instrument, and be assured that it will function with nearly any commercially available ligature and reed designated for that same instrument.

A single reed mouthpiece must fulfill multiple functions. Its ability to fulfill these functions is determined by its shape.

One function of a single reed mouthpiece is to provide a surface called a facing, against which is able be attached the flat side of a flexible reed, made of either natural cane or synthetic material. The facing is a mostly planar surface, but curves slightly away from the flat surface of the reed, as the facing approaches the tip of a mouthpiece. This curvature establishes a narrow wedge-shaped opening between the tip of a reed and the tip of a mouthpiece; a player blows air through this opening.

A second function of a mouthpiece is to provide an opening in the facing called a window, designed to channel the sound energy from the vibrating reed into the bore of the instrument. The window opens into a passage inside the mouthpiece, that leads through the body and out the base of the mouthpiece at the opposite end, and into the tubular bore of the instrument. The window is typically roughly rectangular, and is positioned in the portion of the facing nearest the tip of the mouthpiece, such that it can be covered by the flexible vamp of the reed. The narrow opening between the reed and the tip of the mouthpiece leads directly into the window. A player blows air through the opening and into the window. The air flow causes the flexible reed to rapidly oscillate between open and closed positions over the window, producing oscillating air pressure (sound) waves within the internal cavities of a mouthpiece.

A third function of a mouthpiece is to provide an internal transitional passageway from the window to the tubular bore of the instrument, so that the sound waves initiated in the mouthpiece may resonate in the instrument and produce desirable musical tones.

A fourth function of a mouthpiece is to provide a standardized, tapered exterior wall, that is amenable to the sliding placement, securing, and removal of a ligature. The ligature is used to secure the reed against the mouthpiece. Ligatures of numerous and varied designs are commonly in use. A mouthpiece must allow for easy removal and replacement of any ligature, to allow for exchange of the reed. The necessity for exchange of a faulty reed can arise even during the pressures of a performance setting, and so the external shape of a mouthpiece must interface with ligatures in such a way as to allow reed exchange to be performed quickly and reliably.

A fifth function of a mouthpiece is to provide a convenient external shape near the tip, around which a player may form an air seal with the lips. Creation of at least a partial air seal with the lips is a necessary condition to the playing a single reed instrument, because it allows the player to pressurize the air inside the oral cavity. This elevated pressure causes air from the player's mouth to pass through the opening between the reed and mouthpiece. In the extreme case, if a player could form no air seal with the lips, most of the air blown by a player would escape around the outside of a mouthpiece, the reed would not vibrate, and no desirable sound would result.

The present invention is specifically designed to improve the above stated fifth function of a mouthpiece. The invention is intended to facilitate a more effective air seal by the lips, while simultaneously avoiding detrimental interference with the other functions previously described. In particular, interference with the fourth function stated above (the placement and removal of ligatures) is successfully avoided. The invention accomplishes its purpose by using a pair of protrusions from the sides of a mouthpiece adjacent to the tip, that modify the cross sectional shape of a mouthpiece in that area.

U.S. Pat. No. 5,303,628, entitled "Mouthpiece for A Clarinet And A Saxophone," issued Apr. 19, 1994 (hereinafter "Salazar patent"), discloses "wing members" with substantially semicircular shaped lateral surfaces that are meant to fill gaps between the lips to direct air into the mouthpiece opening. The arcuate edges of the wing members together with the tip form a substantially circular lateral periphery. FIG. 3 of illustrates the ligature 120 being blocked by the substantially circular periphery of wing members 42 disclosed by Salazar. The substantially circular lateral periphery of the wing members as described in the Salazar patent would not allow a ligature 120 to slide over and into position to secure the reed 125 to the mouthpiece 100.

In the Salazar patent, FIG. 4 illustrates the flat surface of the pair of wing members 42. The surface of the wing members 42 adjacent to the facing is flat and lies in a parallel plane with the facing, as disclosed in the Salazar patent. The shape of the wing members 42 in the region where the lips may be applied does not match the natural shape formed by a player's lips.

The present invention is located on the approximately 15-20 mm portions of the curved wall surface on either side of the window, adjacent to the mouthpiece tip (also herein referred to as the "beak tip").

A player typically inserts a mouthpiece tip roughly 15-20 mm into the mouth, passing it between both the lips and teeth, usually with the beak surface oriented towards the upper lip, and the facing surface (covered by a reed) oriented towards the lower lip. Differing techniques exist regarding the placement of a player's lips and teeth relative to the reed and mouthpiece. In all techniques, the lips must apply circumferential pressure inwards around the upper mouthpiece-reed assembly, to perform the necessary function of creating an air seal. The locations of the invention form significant portions of this circumference.

A cross section of a conventional mouthpiece-reed assembly, in the zone to which a player's lips are typically applied, does not correspond to any commonplace geometrical shape. When drawn, the cross section is a four-sided closed figure, with three convex sides and one straight side, and forms four corners at the intersections of the sides. FIG. 7.1 illustrates an example of a cross section of a typical prior art mouthpiece in the area where a player applies their lips.

The purpose of the present invention is to rectify the fact that the cross section of a conventional mouthpiece-reed assembly does not match the natural shape of an opening between a player's lips. Unlike the shape of a conventional mouthpiece in this region, the natural shape formed by the lips when partially open is best described as lens-like, or lenticular. FIG. 7.2 illustrates two examples of abstract lenticular cross sections, one with acute corners (126) and one with rounded corners (127). FIG. 8 illustrates an example of a cross section of the invention, with protrusion members (104) approximating a lenticular cross section.

Due to the mismatch between the shape of a conventional mouthpiece-reed assembly, and the shape naturally formed by the lips, there is a high incidence of air leakage between the lips, on both sides of a conventional mouthpiece. Such leakage occurs at some or all times in the playing of musicians of every level of training and ability. When a player's lips are placed around a mouthpiece, two roughly triangular openings remain, between the lips and the corresponding sides of the mouthpiece adjacent to the tip. Valuable air blown by a player escapes through these openings, and does not enter the instrument. This leaked air is wasted, and its escape creates non-musical noise.

What is desired is a modification to the conventional mouthpiece exterior shape near the tip, such that the cross section in that region more closely matches the natural lenticular shape of the opening between a player's upper and lower lips.

Summary

A mouthpiece for a wind instrument is disclosed. The mouthpiece is configured to work with a reed secured by a ligature.

The mouthpiece includes a longitudinal body having a beak on one end and a connector on the other end. The body has a facing about a window. The facing has a substantially planar surface to support the reed secured to the body using the ligature. A portion of the facing has a curvature away from the plane of the substantially planar surface as it extends along a longitudinal axis of the body towards the tip of the beak.

The connector is configured to couple a bore of the mouthpiece to the bore of the wind instrument.

The mouthpiece has a pair of protrusions wherein each protrusion extends laterally from the respective side of the window adjacent to the tip, the protrusions extending along the longitudinal axis of the body along a segment at least corresponding to a region where players may apply their lips to the body when playing the instrument.

The protrusion members of the invention alter the exterior shape of a conventional prior art single reed mouthpiece in such a way as to transform the cross section in the area to which a player's lips are applied. They transform said cross section from a conventional four sided cross section, to a lenticular cross section that matches the natural shape of the opening between the lips, and improves the ability of a player to create an air seal with the lips. The improved exterior shape is novel, and provides numerous benefits to the player.

The protrusion members avoid interference with any other functions of a mouthpiece, particularly avoiding detrimental interference with the action of ligatures as they slide on and off the mouthpiece. Creating specific shapes and dimensions of the protrusions that can accomplish the purpose of the invention without such ligature interference requires evaluation of complex three-dimensional interactions between ligatures and the tapering shape of a mouthpiece with the invention protrusions. Such evaluation requires iterative prototyping and testing, or possibly three-dimensional computer modeling, and is thereby non-obvious.

The protrusion members in different embodiments may be configured to be manufactured as a single body with a mouthpiece; alternatively, the protrusion members may be configured to be manufactured separately from and attached to an existing prior art mouthpiece, using tape, glue or another method of attachment.

DESCRIPTION OF THE DRAWINGS

FIG. 7.2 illustrates two embodiments 126 and 127 of an abstract lenticular cross section.

DETAILED DESCRIPTION

Figure 2:
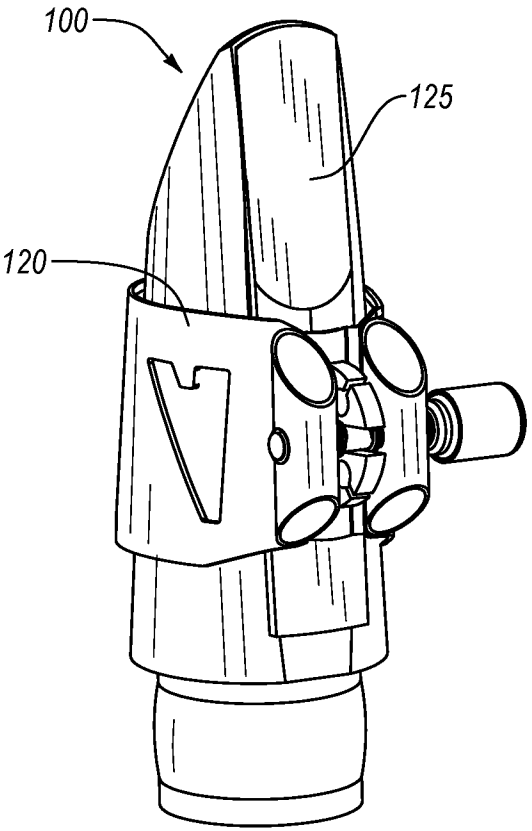
FIG. 2 (Prior Art)
FIG. 2 illustrates one embodiment of a prior art mouthpiece having a prior art ligature positioned for operation.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the subject matter described herein without departing from the scope of the disclosure. For example, features of the mouthpiece or the musical instrument may be formed as part of a single piece or assembled from distinct components.

A single-reed wind instrument is a musical instrument that includes a resonator—usually a tube —in which a column of air is set into vibration by the player blowing into the narrow opening between the reed and the tip of the mouthpiece at or near an end of the resonator.

A mouthpiece for a wind instrument includes a body having a generally longitudinal shape with the tip of a beak on one end and a connector such as a tenon or shank on the other end. The connector is configured to attach the mouthpiece to the rest of the musical instrument. In some embodiments, the mouthpiece is about 8 to 10 centimeters long.

A tenon, for example, couples the mouthpiece to a mortise of the rest of a wind instrument. A shank, for example, similarly couples a mouthpiece to the neck of a wind instrument. The wind instrument may be a clarinet or saxophone, for example.

Figure 1:
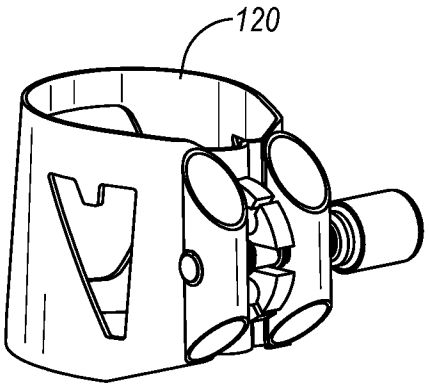
FIG. 1 (Prior Art)
FIG. 1 illustrates a one embodiment of a prior art ligature.
Figure 3:
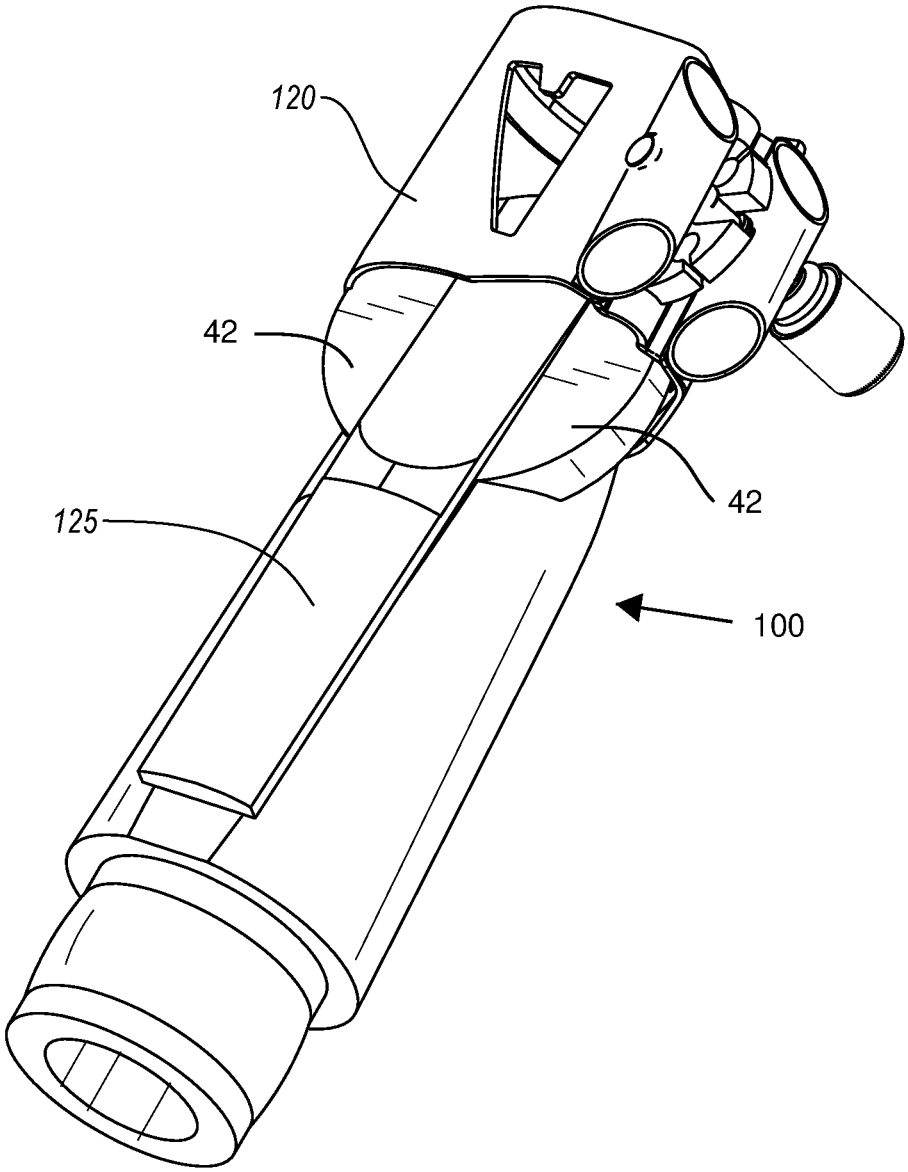
FIG. 3 (Prior Art)
FIG. 3 illustrates a prior art ligature blocked from sliding into position by the protrusions of a prior art mouthpiece.

FIG. 1 illustrates a prior-art embodiment of a ligature 120. The ligature 120 sides over a beak tip of a mouthpiece to hold a reed against the facing of the mouthpiece.

FIG. 2 illustrates a prior-art embodiment of a mouthpiece 100 having the ligature 120 in position to hold a reed 125 in position on the mouthpiece 100.

Figure 4:
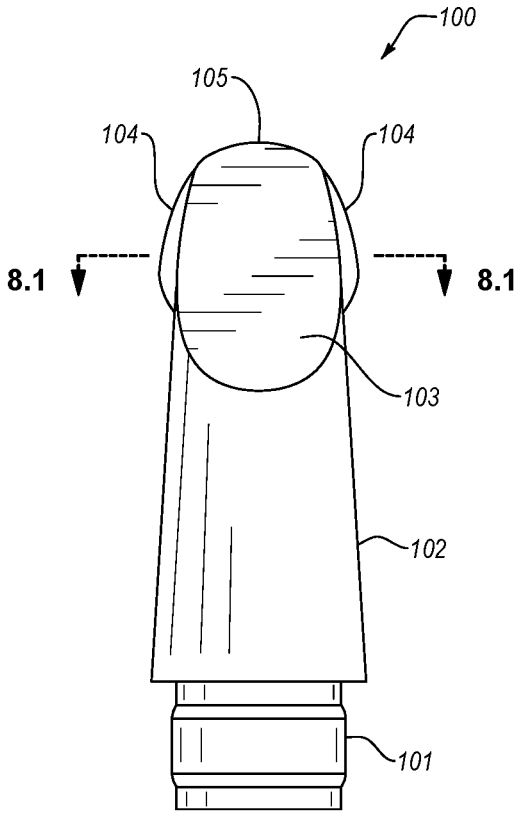
FIG. 4 illustrates a beak view of one embodiment of a clarinet mouthpiece including cross-section indication for FIG. 8.1.

FIG. 4 illustrates a beak view of one embodiment of the mouthpiece 100 having a body 102. (Hereinafter, in descriptions of the drawings, the term "body" shall also be interchangeable with "wall surface of the body" and "wall".) A beak tip 105 is on the end about which the player applies their mouth. A tenon 101 is used to connect the mouthpiece 100 to the rest of the musical instrument (not shown).

The mouthpiece 100 has two protrusions 104 extending laterally from the mouthpiece 100 adjacent to the beak tip 105. The protrusions 104 are positioned and shaped to allow the mouthpiece to match the shape of the player's lips as applied to the mouthpiece 100 when playing the musical instrument.

In some embodiments, the body 102 of the mouthpiece 100 is formed with the protrusions described herein. For example, the body 102 may be formed with protrusions 104 as part of the same piece. A manufacturing process may use computer numerical control (CNC) machining, for example, to achieve the mouthpiece shape with protrusions according to the inventive subject matter.

Figure 8:
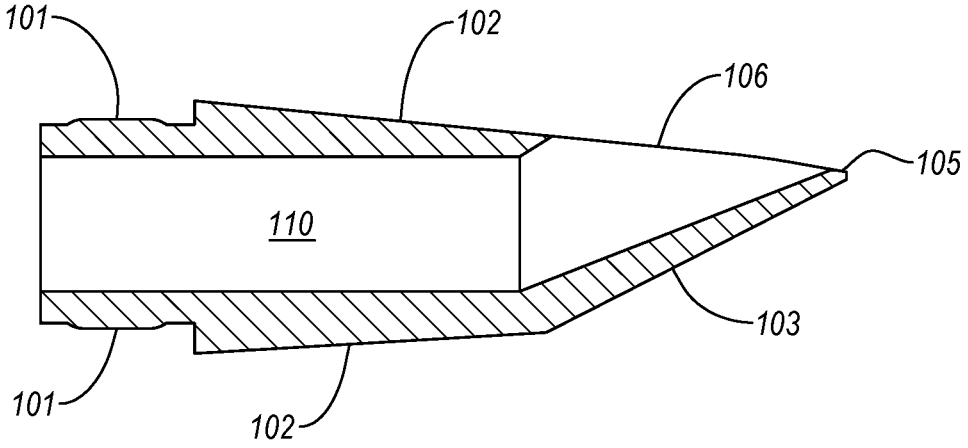
FIG. 8.1 illustrates a cross section of the invention.

FIG. 4 includes an indication as to the position of the cross-section shown in FIG. 8.1.

Figure 5:
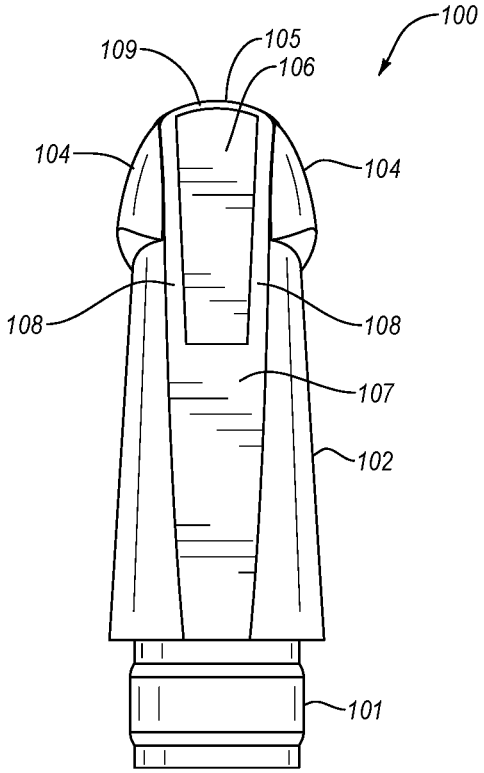
FIG. 5 illustrates a facing view of one embodiment of the present invention.

FIG. 5 illustrates a facing view of one embodiment of the mouthpiece 100 with the body 102 having two protrusions 104, and the tenon 101. The mouthpiece 100 includes a facing 107 having a substantially planar surface for supporting a reed (not shown) and two side rails 108 and a tip rail 109 surrounding a window 106 that leads to a bore within the body 102.

The facing 107 abbreviates the conically shaped portion. The facing 107 includes (1) a portion having a substantially planar surface to support a reed (not shown) secured to the body 102 with a ligature and (2) a portion having a curvature away from the plane of the substantially planar surface as the facing extends about the longitudinal axis of the body towards the beak tip 105.

The facing 107 surrounds the window 106 between the side rails 108 and the tip rail 109. The portion of the facing 107 on the connector side of the window 106 is also known as a table.

When preparing the mouthpiece for playing the instrument, a reed is placed on the facing 107. A bark end of the reed is positioned over the table. A ligature slides over the mouthpiece from the beak tip 105, positioned over the table, and tightened to secure the reed to the table. The vamp end of the reed is positioned to cover the window 106 and is free to vibrate over the window 106.

When the reed is properly positioned and secured to the body with the ligature, there is an opening between the beak tip 105 and the tip of the reed. The player blows through that opening to play the musical instrument.

FIG. 5 illustrates a facing view of one embodiment of a mouthpiece 100 of the present invention, with a tenon 101, a wall 102, protrusion members 104, a tip 105, a window 106, a table 107, side rails 108, and tip rail 109.

Figure 6:
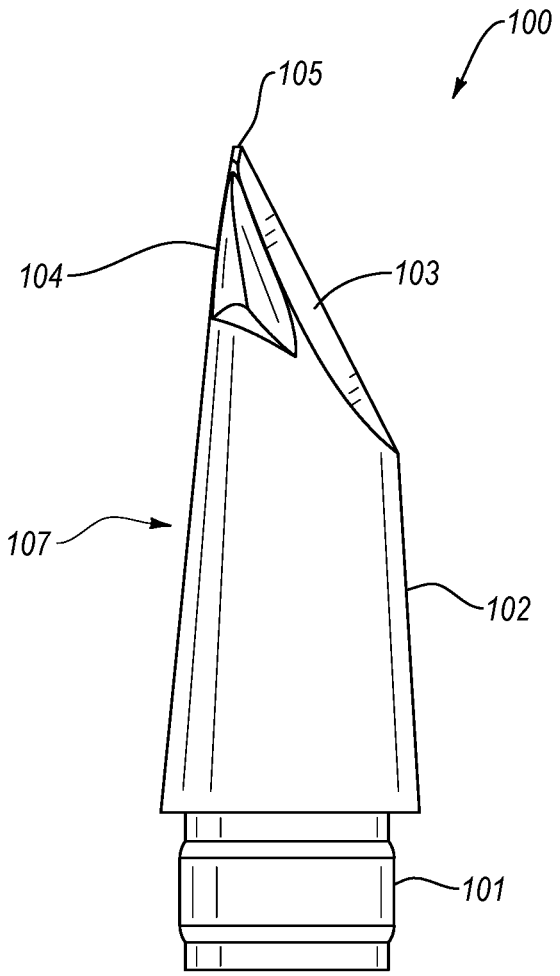
FIG. 6 illustrates a side view of one embodiment of a clarinet mouthpiece.

FIG. 6 illustrates a side view of one embodiment of the mouthpiece 100 with the body 102 having a beak 103 extending to the beak tip 105 and the tenon 101. One of the two protrusions 104 is shown.

FIG. 8.1 illustrates a cross section of the invention in the location indicated in FIG. 4, with beak 103, window 106, reed 125, and protrusion members 104.

The portion of the body 102 extending from the tenon 101 is roughly conically shaped gradually tapering as it extends towards the beak tip 105. The roughly conical shape is abbreviated by the beak 103 and the facing 107.

The beak 103 is at an obtuse angle with the conically shaped portion. The facing 107 is on the opposite side of the body 102 as the beak 103. The facing 107 and the beak 103 come together to form the beak tip 105.

Figure 7:
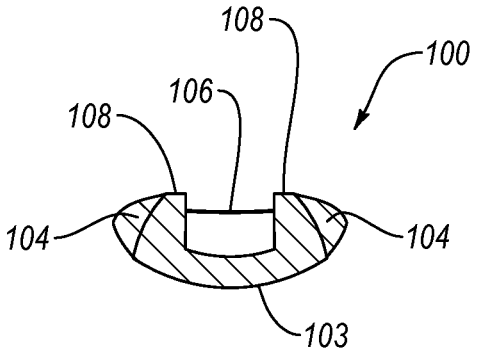
FIG. 7.1 illustrates a cross section of a prior art mouthpiece, in the area where a player places their lips.

FIG. 7 shows a cross-section of the mouthpiece of FIG. 4 In the position indicated in FIG. 1. The cross-section shows the mouthpiece 100 with the body 102 having the beak 103 and the two protrusions 104.

The two of protrusions 104 on the body 102 extend laterally on either side of the window 106 adjacent to the tip of the beak. In one embodiment, a first surface of each protrusion 104 is substantially flush with the beak 103 and a second surface of each protrusion 104 is substantially flush with the side rails 108. The first and second surfaces of each protrusion 104 have a curvature towards the middle as each protrusion 104 extends out laterally from the body 102. The shape of each protrusion 104 as positioned on the mouthpiece 100 at the region where players apply their lips is configured to fill the corners of a player's mouth as applied when operating the musical instrument.

In some embodiments, the cross-section of FIG. 8.1 is indicative of the profile of the mouthpiece along the length of the protrusions 104 where players generally apply their lips from a predetermined near-end to a pre-determined far-end as measured from the beak tip 105.

The surface of the body 102 on which each protrusion 104 is mounted (or with which it is integrated) gradually widens from a central longitudinal axis of the mouthpiece 100 because of the tapered shape of the body 102 as the position along the protrusion 104 approaches the tenon 101.

In some embodiments, the protrusions 104 are configured to compensate for the taper of the body 102 so that each protrusion 104 extends a substantially constant distance from a central longitudinal axis of the mouthpiece along the length of the protrusions 104 in the region where players generally apply their lips from a predetermined near-end to a pre-determined far-end, as measured from the end of the corresponding side rail 108 adjacent to the beak tip 105.

In some embodiments, the predetermined near-end of the region where players generally apply their lips is about 10 millimeters from the end of the corresponding side rail 108 adjacent to the beak tip 105 and the predetermined far-end of the region where players generally is about 15 millimeters from the end of the corresponding side rail 108 adjacent to the beak tip 105. In other embodiments, the predetermined near-end is less than 10 millimeters from the corresponding side-rail 108 adjacent to the beak tip 105 and the predetermined far-end is greater than 15 millimeters from the corresponding side-rail 108 adjacent to the beak-top 105.

In some embodiments, the protrusions 104 extend to fill the gaps in the corners of the player's mouth as applied to the protrusions 104 anywhere from the pre-determined near end to the pre-determined far end.

In some embodiments, as each of the protrusions 104 extends beyond the predetermined far end from the beak tip 105, there is a discontinuity in the lateral extent of any protrusion such that it is reduced or eliminated a short distance from the predetermined far end from the beak-tip. The discontinuity better accommodates common commercial ligatures because the worst-case geometry is reduced.

In some embodiments, the first surface of each protrusion 104 is substantially flush with the beak 103 when the worst-case discontinuity between the first surface and the beak 103 within the region between the pre-determined near-end and the predetermined far-end is less than approximately plus or minus 1 millimeter.

In some embodiments, the second surface of each protrusion 104 is substantially flush with the side rails 108 when the worst-case discontinuity between the second surface and the side rails 108 within the region between the pre-determined near-end and the predetermined far-end is less than approximately plus or minus 1 millimeter.

The improved shape of the first and second surfaces of each protrusion 104 allows the musician to more easily and comfortably prevent the escape and wasting of pressurized air around the sides of the mouthpiece 100. This pressurized air may be redirected to its intended purpose: causing vibration of the reed to create the desired sounds of the instrument. The redirected air does not escape through the gaps at the corners of the lips.

The type of air leakage described is common among clarinet players of all skill levels, to some degree, at times during their playing using prior-art mouthpieces.

In some embodiments, the shape of the first and second surfaces for a pair of protrusions have curvatures optimized to fit the range of shapes of a broad range of players' lips. Other embodiments of the protrusions may be tailored to the shape of lips for particular segments of players. For example, there may be small, medium and large versions of the protrusions 104 to fit different size mouths. In some embodiments, the cross section of the protrusion 104 may change from the near end to the far end from the beak end such that different players may find the position along the protrusions 104 that is more comfortable for them.

By reducing the force applied by the lips used to create this external air seal, clarinetists may have less fatigue of the lip muscles. The lip muscles are commonly one of the first essential muscle groups to fatigue in extended continuous clarinet playing.

Many prominent orchestral solos, for example, are composed in such a manner as to require long passages to be played in a single breath. By reducing or eliminating the air lost to leakage, the clarinetist may extend the length of musical passages they can play with a single breath.

By reducing the required tension of the orbicularis oris muscle, the inventive subject matter may reduce overall excessive muscle tension in other important muscle groups, specifically the tongue, as well as the jaw and cheek muscles. Such a reduction in excess and wasted muscle tension in one area (the lips) may allow for more accurate and less fatiguing technique in the other relevant muscle groups, particularly when playing in the altissimo (highest) register of the instrument. Playing in the altissimo register of the clarinet requires accuracy in small and precise movements of these muscles and structures.

muscle groups, specifically the tongue, as well as the jaw and cheek muscles. Such a reduction in excess and wasted muscle tension in one area (the lips) may allow for more accurate and less fatiguing technique in the other relevant muscle groups, particularly when playing in the altissimo (highest) register of the instrument. Playing in the altissimo register of the clarinet requires accuracy in small and precise movements of these muscles and structures.

The inventive subject matter also reduces noise created by the air leakage itself, which can be distracting from the music the musician wishes to project to the audience.

By reducing the force necessary from the lip muscles (orbicularis oris) to create this external air seal, the inventive subject matter could extend the amount of time a clarinetist can play continuously before reaching fatigue of the lip muscles. The lip muscles are commonly one of the first essential muscle groups to fatigue in extended continuous clarinet playing.

An effective articulation method in clarinet playing involves touching the tip of the tongue on the tip of the reed, stopping its vibration temporarily, and temporarily slowing or stopping air flow into the mouthpiece. When performed optimally, this stoppage causes temporary elevation of the pressure of the air in the mouth. This elevated pressure can increase unwanted air leakage around the mouthpiece, tempting the clarinetist to use suboptimal articulation control by involving the glottis, rather than using the tongue exclusively. The inventive subject matter allows the musician to more easily control this articulation-associated leakage, without resorting to suboptimal glottis-based articulation habits.

The bore 110 of the mouthpiece 100 is coupled to the bore of the rest of the musical instrument (not shown) by attaching a tenon of the mouthpiece 100, for example, to the mortise at the connecting end of the rest of the musical instrument (not shown). The column of air is communicated from the opening at the beak tip 105 through the bore to exit the musical instrument at a bell (not shown).

Alternative embodiments of the mouthpiece 100 have a shank to couple to a corresponding feature at the connecting end of the musical instrument.

Figure 9:
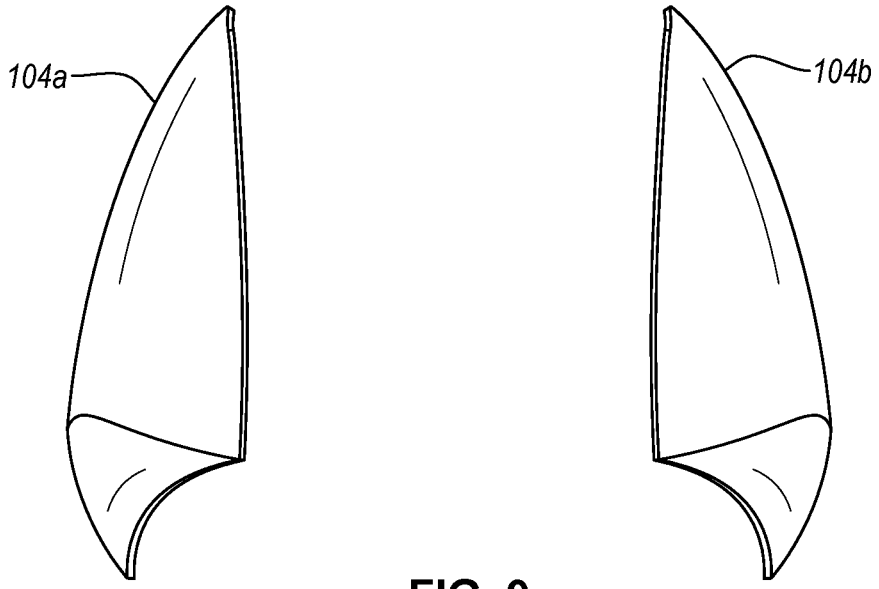
FIG. 9 illustrates a beak-side view of one embodiment of a pair of protrusion members.

FIG. 9 shows a facing side perspective view of one embodiment of a first protrusion member 104*a* and a second protrusion member 104*b*.

Figure 10:
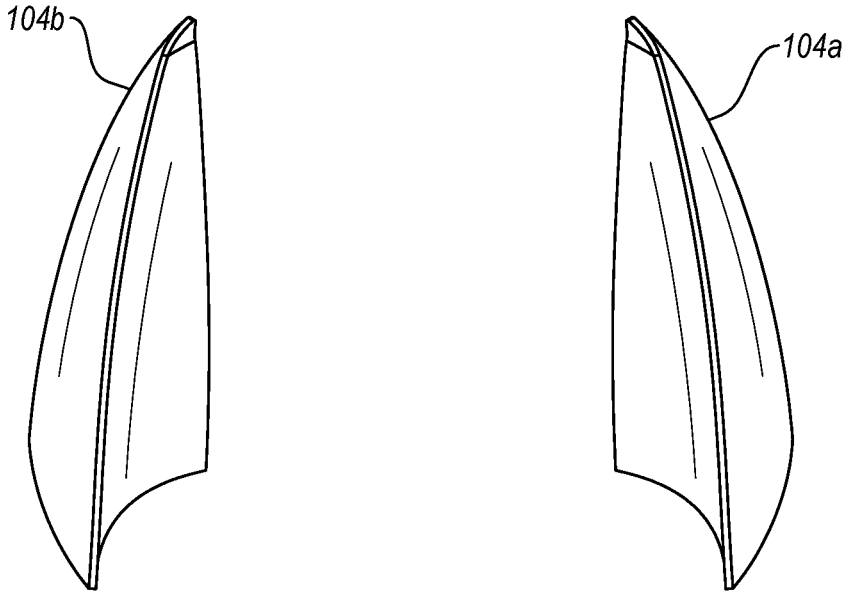
FIG. 10 illustrates a facing-side view of one embodiment of a pair of protrusion members.

FIG. 10 shows a beak side perspective view of one embodiment of the first protrusion member 104*a* and the second protrusion member 104*b*.

Figure 11:
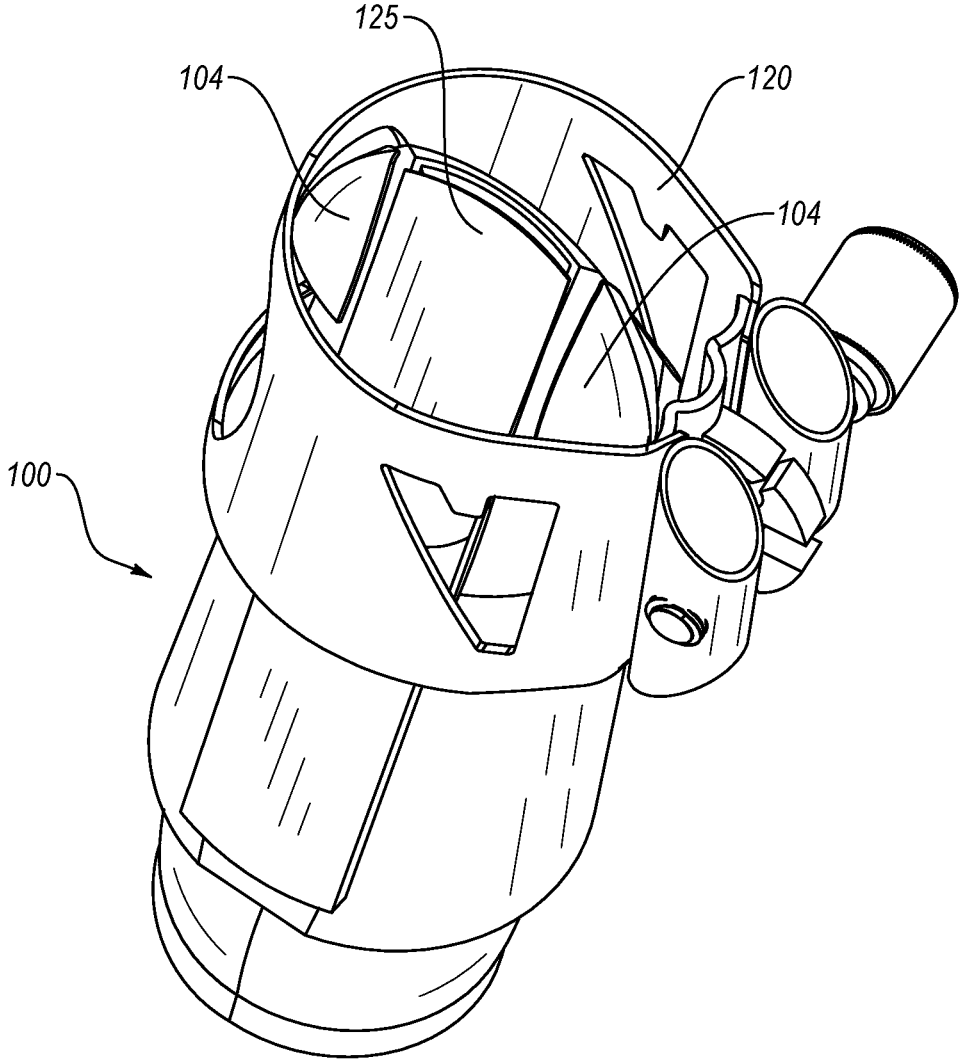
FIG. 11 illustrates a ligature sliding into position past the protrusions for one embodiment of a mouthpiece.

FIG. 11 shows a ligature 120 in the process of sliding over the mouthpiece 100 having a reed 125 and two protrusions 104 of the inventive subject matter.

In some embodiments, each protrusion 104 is a separate add-on member coupled to the body 102. These add-on members may be glued or fastened, for example, to the surface of a commercial mouthpiece at the appropriate positions to form protrusions according to the inventive subject matter.

In some embodiments, the two add-on members are manufactured separately and sold to be applied to mouthpieces that do not have protrusions. In some embodiments, the add-on members are manufactured using a plastic injection molding process.

In some embodiments, the add-on members allow for modification of pre-existing mouthpieces. A musician may use add-on members to modify mouthpieces they already own. In some embodiments, there are several variations of the add-on members, each variation individually tailored to the geometry of one or more commercially available mouthpiece models.

In some embodiments, the mouthpiece and add-on members further include corresponding features for proper alignment of each add-on to the mouthpiece. In some embodiments, each add-on member has male or female features at two or more locations to interface with a corresponding female or male feature for each of the lateral sides of the window. The add-on member may be aligned using the features and attached using glue. Screws and other methods of aligning or securing the add-on members to the mouthpiece may be used.

The add-on members may be aligned and coupled to mouthpieces using any number of methods that are within the spirit and scope of the inventive subject matter.

Figure 12:
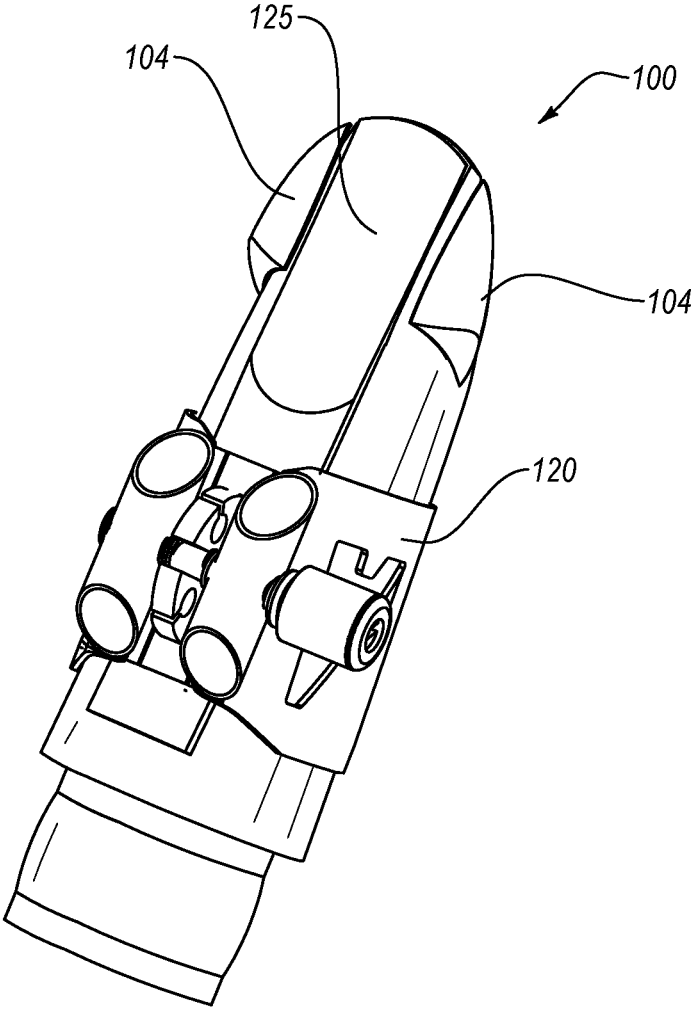
FIG. 12 illustrates one embodiment of a mouthpiece having a ligature positioned for operation.

FIG. 12 shows a ligature 120 positioned on the mouthpiece 100 with two protrusions 104 of the inventive subject matter.

Components of the mouthpiece such as the protrusions may comprise various materials including ivory, rubber, glass, crystal, wood, plastic, or metal.

Although specific advantages have been enumerated above, various embodiments may not include some or all of the enumerated advantages.

What is claimed is:

1. A mouthpiece for a single reed wind instrument, the mouthpiece configured to work with a reed secured by a ligature, the mouthpiece comprising:

a body being longitudinal having a beak on a first end and a connector on a second end, the body comprising three primary surfaces, these surfaces being a wall, a beak, and a facing containing a window, the facing comprising a substantially planar surface to support the reed secured to the body using the ligature, a portion of the facing having a curvature away from the plane of the substantially planar surface as it extends along a longitudinal axis of the body towards a beak tip, a connector being configured to couple a bore of the mouthpiece to the bore of the wind instrument; and a pair of protrusions wherein each protrusion extends laterally from the wall of the body adjacent to the beak tip, the protrusions extending along the longitudinal axis of the body along a segment at least corresponding to the region where players apply their lips to the body when playing the wind instrument, and the protrusions having a first surface that is substantially flush with the facing, and a second surface that is substantially flush with the beak.

2. The mouthpiece of claim 1 wherein the first surface and the second surface of each of the pair of protrusions come together as each surface extends laterally from the body in a direction away from the window, the pair of protrusions configured to give the mouthpiece a substantially lenticular cross section, in the region where a player applies their lips, that approximates the natural shape of the opening between human lips as applied to the beak tip during the playing of a single reed wind instrument.

3. The mouthpiece of claim 1 wherein the wind instrument is a clarinet.

4. The mouthpiece of claim 1 wherein the wind instrument is a saxophone.

5. The mouthpiece of claim 1 wherein the wind instrument is a single-reed wind instrument.

6. The mouthpiece of claim 1 wherein the first surface of each protrusion curves away from the plane of the facing in the direction of the beak, and the second surface substantially continues the curvature of the beak in the direction of the facing.

7. A pair of protrusion members configured to be manufactured independently of and subsequently attached to a body of a pre-existing conventional mouthpiece for a wind instrument, said mouthpiece having a wall and a beak and a facing with a window, and wherein each claimed protrusion member is configured to couple to said mouthpiece and extend laterally from the wall of the body of the mouthpiece, on either side of the window adjacent to a beak tip, each of the pair of protrusion members having a first surface that is substantially flush with the facing, and a second surface that is substantially flush with the beak.

8. The pair of protrusion members of claim 7 wherein each member is configured to be coupled to a mouthpiece for a wind instrument using glue, tape, or another method of adhesion or attachment.

9. The protrusion members of claim 7 wherein the first surface and the second surface of each of the pair of protrusion members come together as each of the protrusion members extends laterally from the body, the protrusion members configured to form a substantially lenticular cross section in combination with said pre-existing mouthpiece, in the region where a player applies their lips, that approximates the natural shape of the opening between human lips as applied to the beak tip during the playing of a single reed wind instrument.

10. The protrusion members of claim 7 wherein the first surface of each protrusion curves away from the plane of the facing in the direction of the beak, and the second surface substantially continues the curvature of the beak in the direction of the facing.

* * * * *